US005531829A

United States Patent [19]

Yasoshima

[11] Patent Number: 5,531,829

[45] Date of Patent: Jul. 2, 1996

[54] FAN-SHAPED STAMP PAD

[75] Inventor: Haruo Yasoshima, Tokyo, Japan

[73] Assignee: Tsukineko, Inc., Redmond, Wash.

[21] Appl. No.: 361,334

[22] Filed: Dec. 21, 1994

[51] Int. Cl.[6] ..... B05C 1/00

[52] U.S. Cl. ..... 118/264; 101/327; 101/333; 118/265; 118/269; 434/84

[58] Field of Search ..... 118/264, 265, 118/269; 101/327, 333; 434/84; D18/17

[56] References Cited

U.S. PATENT DOCUMENTS

| | | | |
|---|---|---|---|
| D. 247,063 | 1/1978 | Funahashi | D64/10 |
| D. 252,935 | 9/1979 | Henkels | D19/77 |
| D. 331,418 | 12/1992 | Winston | D18/15 |
| 602,061 | 4/1898 | Echelberger | 118/264 |
| 848,063 | 3/1907 | Sommer | 118/264 |
| 1,173,092 | 2/1916 | Bickerton | 118/270 |
| 1,463,718 | 7/1923 | Munson | 118/264 |
| 1,796,137 | 3/1931 | Baumgarten | 118/264 |
| 2,117,470 | 5/1938 | Zareko | 118/264 |
| 2,290,488 | 7/1942 | Munson | 118/264 |
| 2,422,814 | 6/1947 | Alexander | 101/333 |
| 2,723,476 | 11/1955 | Lyon | 118/264 |
| 3,326,180 | 6/1967 | Lofgren | 118/264 |
| 4,029,011 | 6/1977 | Kurner | 101/327 |
| 4,986,175 | 1/1991 | Boehringer | 101/125 |

FOREIGN PATENT DOCUMENTS

| | | | |
|---|---|---|---|
| 662905 | 6/1938 | Germany | 101/333 |
| 4940 | 4/1896 | United Kingdom | 118/264 |
| 2045687 | 11/1980 | United Kingdom . | |

OTHER PUBLICATIONS

Ink–A–Dink–A–Do, *4 inks in One,* Stamp Pad. (Publication date unavailable).

Ivory Coast Trading Poste®, *Stamp Pad: Billiant Stamping Inks—always ready to use. (Publication date unavailable).*

Rubber stamp catalog, Clearsnap, Inc., 1990.

Tsukineko, Color palette Pigment Stamp Pad Catalog, Japanese language document. (Publication date unavailable).

Tsukineko, Japanese Catalog, 1993.

*Primary Examiner*—Laura Edwards

*Attorney, Agent, or Firm*—Seed and Berry

[57] ABSTRACT

A fan-shaped stamp pad that provides from one to a multitude of differently colored inks to a single stamp, at the option of a user. Additionally, the fan-shaped stamp pad permits the application of a great number of colors of ink to a stamp while requiring only one application of the stamp to the stamp pad, thereby reducing the chance of smearing, or otherwise contaminating, the ink from one section of the pad to another.

4 Claims, 2 Drawing Sheets

FAN-SHAPED STAMP PAD

TECHNICAL FIELD

The field of the present invention is ink-impregnated stamp pads and stamps.

BACKGROUND OF THE INVENTION

A stamp pad impregnated with ink has been used for centuries as an ink reservoir. The ink contained in the pad can be applied to a rubber stamp and transferred to a desired surface, such as a paper document. Traditionally, these stamp pads supplied a single drab color of ink, such as basic red, blue or black, and the stamp contained a word or symbol peculiar to a workplace environment, such as the well known USDA stamp that is found on meat and the stamps found on various office papers. In such situations, it is typical to have a stamp pad containing only a single color of ink.

Over the last several decades, the use of stamp pads as artistic devices has grown dramatically. Such stamp pads typically contain a bright, cheery color, or a color peculiar to a particular season, such as orange for Halloween. The stamp used with the stamp pad has evolved with this artistic trend, and often now conveys a personal message or an artistic symbol, such as a flower. The advent of artistic stamp pads has also led to the production of stamp pads containing multiple colors of ink in a single pad. Such a multi-hued pad is created by placing a series of linear strips of pad in a side-by-side relation, with each strip having a different color. Examples of these types of stamp pads are set forth in the *Tsukineko* 1993 *Catalog*, as well as catalogs available from other stamp pad manufacturers and dealers. In another embodiment, as shown in British patent No. 4940, the stamp pads have multiple sections divided by raised ridges.

However, the linear-strip arrangement and raised dividing ridges of these stamp pads do not allow the user, at his or her option, to use a single stamp and stamp pad to transfer anywhere from one to a large multitude of colors. Accordingly, there has gone unmet the need for a stamp pad that empowers a user apply a stamp in a single place to transfer a single color of ink, or, when desired, to apply the stamp in a single place and transfer up to five, ten, or more colors. The present invention provides these and other related advantages.

SUMMARY OF THE INVENTION

The present invention is directed to a fan-shaped stamp pad that provides from one to a multitude of differently colored inks to a single stamp, at the option of a user.

In a first aspect, the present invention provides a fan-shaped stamp pad comprising at least three sections containing differently colored inks, each of the sections meeting at a series of junctures and radiating from a central region of the stamp pad, and each of the sections having a proximal region located near the central region and a distal region located distant from the central region, the proximal region having a shorter width than the distal region.

In another aspect, the present invention provides a stamp kit comprising a fan-shaped stamp pad and a stamp. The stamp pad comprises at least three sections containing differently colored inks, the sections meeting at a series of junctures and radiating from a central region of the stamp pad, and each of the sections having a proximal region located near the central region and a distal region located distant from the central region, the proximal region having a shorter width than the distal region. And, the stamp is sized such that a single diameter of the stamp contacts three or more of the sections of the stamp pad when applied to the central region of the stamp pad, but contacts only one of the sections when the stamp is applied far from the central region.

In a prefected embodiment, the stamp is sized such that the single diameter contacts all of the sections when applied at the central region.

In further aspect, the present invention provides a stamp pad comprising at least five sections containing differently colored inks, each of the sections meeting at a series of junctures and radiating from a central region of the stamp pad, and each of the sections having a substantially triangular shape with a point of the triangle located at the central region.

In yet another aspect, the present invention provides a stamp pad comprising means for permitting a single diameter of a stamp to contact a single ink at a first area of the stamp pad and means for permitting the single diameter to contact three or more differently colored inks at a second area of the stamp pad.

In preferred embodiments, the stamp pads of the present invention comprise at least five sections that radiate from the central region of the stamp pad. In alternative preferred embodiments the central region of the stamp pad is located at a corner or a center of the stamp pad, and the stamp pad is attached to a plastic base, typically by a bottom surface of the stamp pad.

These and other aspects of the present invention will become evident upon reference to the following detailed description and attached drawings.

DETAILED DESCRIPTION OF THE INVENTION

The present invention is directed to a fan-shaped stamp pad that provides from one to a multitude of differently colored inks to a single stamp, at the option of a user. The fan-shaped stamp pad permits the application of a great number of colors of ink to a stamp while requiring only one application of the stamp to the stamp pad, thereby reducing the chance of smearing, or otherwise contaminating, the ink from one section of the pad to another.

Figure 1:
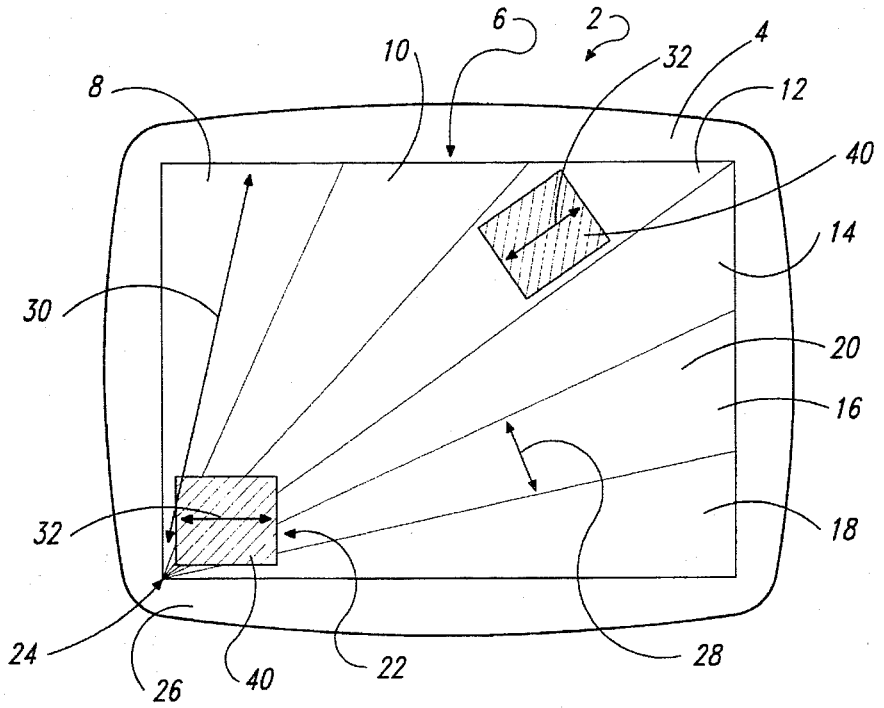
FIG. 1 depicts a plan view of a generally rectangular stamp pad with a fan-shape radiating from a comer of the pad. A stamp applied to the pad in two places is shown in cross section.

Turning to the Drawings, FIG. 1 depicts an embodiment of the present invention wherein a stamp pad and base combination 2 provides a number of sections of varying widths. The stamp pad and base combination comprises a stamp pad 6 attached by a bottom surface to a base 4. The stamp pad 6 is typically made of felt, foam or other absorbent material known in the art, and the base 4 is preferably made of plastic or metal.

The stamp pad 6 is divided into a number of sections, 8, 10, 12, 14, 16 and 18. The width of each section increases from a proximal region 22 to a distal region 20 of the section. The "proximal region" of each section is that region of the section that is located near to a central region 24 of the stamp pad 6. The "central region" is an area of the stamp pad wherein three or more, and preferably 5 or more, sections converge. The "distal region" of a section is that part of a section located away from such a central region. As noted above, each section increases in width from the proximal region 22 to the distal region 20, and preferably the section continuously increases in width as the length 30 of the section increases from the distal end of the section to the proximal end. Because the proximal regions of at least three sections converge at the central region, the sections radiate from such central region and, in combination with the increasing width of the sections toward the proximal region of the sections, the array of sections provides a fan shape. In FIG. 1, the fan shape radiates from a corner 26 of the stamp pad 6 and the base 4.

It is a feature of the present invention that, due to the increasing width of the sections of the stamp pad 6, a single diameter 32 of a single stamp 40, shown in cross section in FIG. 1, can be applied at either the proximal region 22 or the distal region 20 of the sections and yet contact one, two, three, four, sections at the option of the user, without the need for extra stamps or stamp pads. A single diameter 32 of the stamp 40 can be thus applied to only a single color (i.e., contacts only a single section), or six colors (as in FIG. 1) or even nine or more colors (as in FIG. 2), by contacting the stamp pad near the central region 24.

Figure 2:
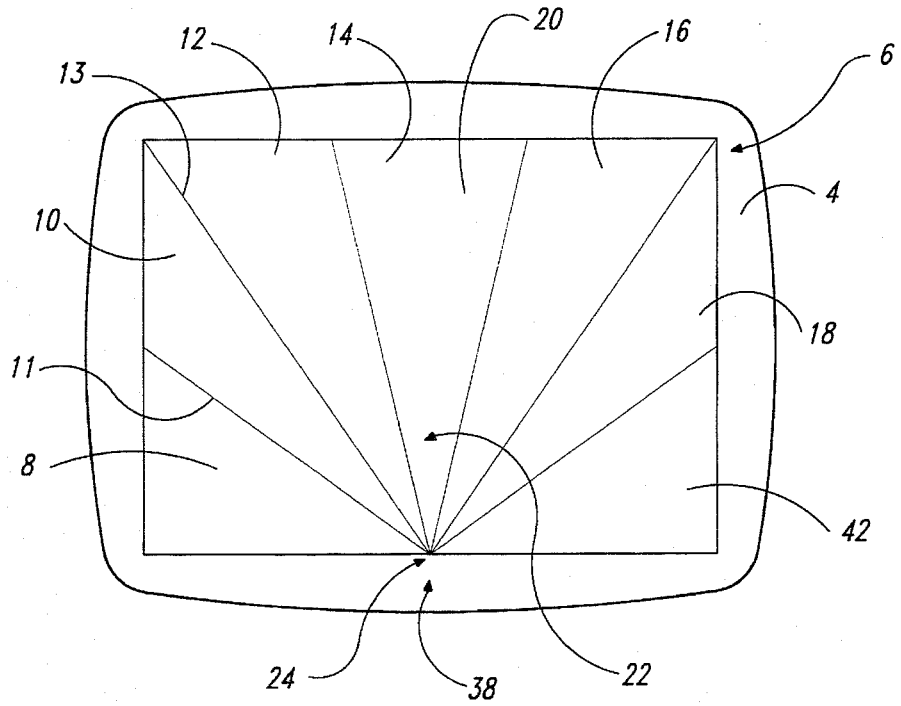
FIG. 2 depicts a plan view of a generally rectangular stamp pad with a fan-shape radiating from the center of a bottom edge of the pad.

Adjacent sections, for example 8, 10 and 12 in FIG. 2, meet at a series of junctures, such as 11 and 13 in FIG. 2. The junctures do not separate the sections by use of ridges that extend above the pad, or other such dividing material, that could prevent the stamp from simultaneously contacting more than one section at the same time. Rather, the junctures provide a substantially level surface from one section to the next. Preferably, the sections contact one another at the junctures.

FIG. 2 depicts an alternative embodiment of the invention wherein the central region 24 is located along a center of an edge 38 of the stamp pad 6.

Figure 3:
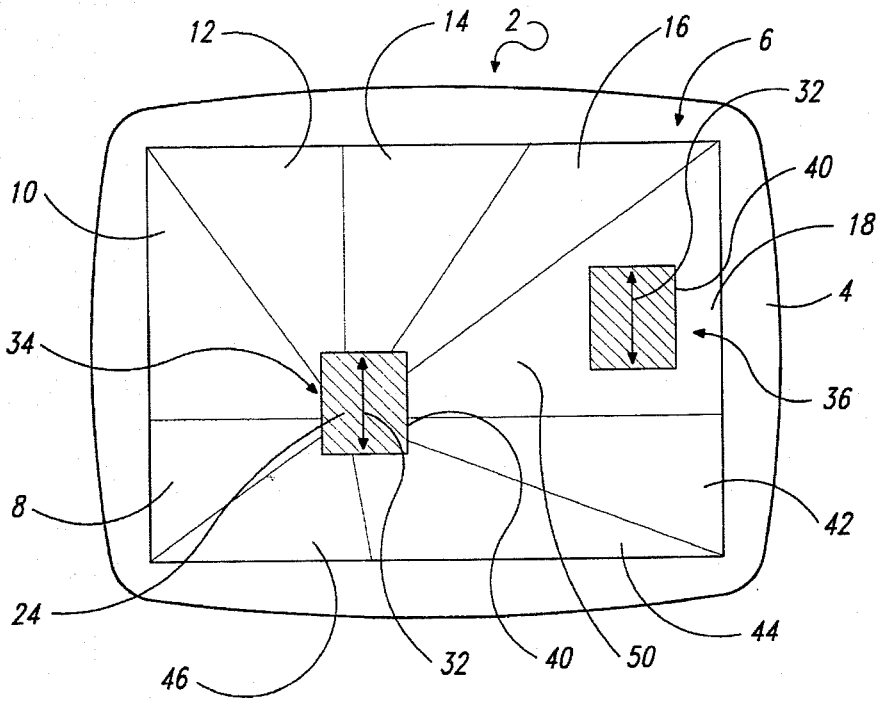
FIG. 3 depicts a plan view of a generally rectangular stamp pad with a fan-shape radiating from off-center of the pad, a stamp applied to the pad in cross section.

FIG. 3 depicts another alternative embodiment of the invention, wherein the central region 24 is located just off of center 50 of the stamp pad 6. As also depicted in FIG. 3, the stamp pad of the present invention provides means for permitting a single diameter 32 of a single stamp 40 to contact a single ink at a first area 36 of the stamp pad while contacting three or more differently colored inks at a secondary area 34 of the stamp pad. FIG. 3 also depicts an embodiment wherein seventh, eighth, and ninth sections (42, 44 and 46) are provided in the stamp pad 6.

Figure 4:
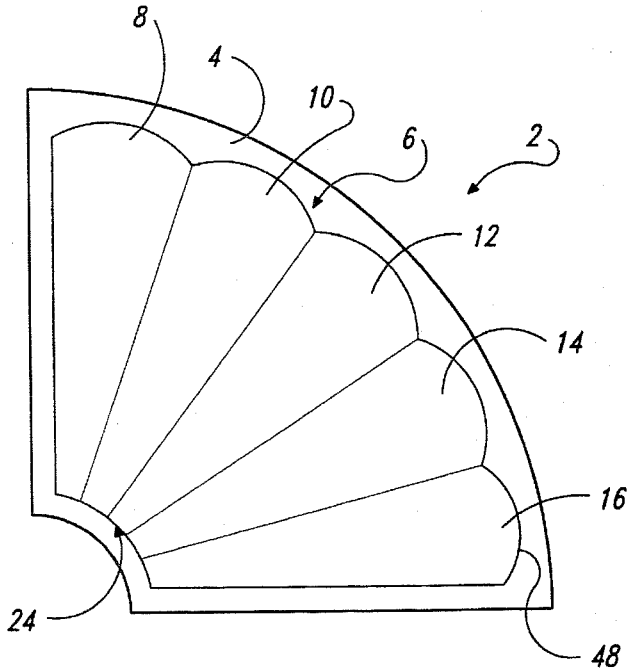
FIG. 4 depicts a fan-shaped stamp pad generally in the shape of a seashell, the sections of the pad being pointed at their distal ends.

FIG. 4 depicts yet another alternative embodiment of the present invention wherein the sections of the stamp pad 6 converge at a central region 24 that is not a single point, and wherein the base 4 and stamp pad 6 are configured in a seashell shape. Further, the sections 8, 10, 12, 14, and 16 of FIG. 4 have a rounded edge 48 at the distal end of each section.

As depicted in each of FIGS. 1–4, in a preferred embodiment each of the sections has a substantially triangular shape, with a point of the triangle located at the central region 24. In such a preferred embodiment, the area of contact between adjacent sections forms a straight line extending from the central region 24 to the distal region of the stamp pad 6, although the distal end of the sections may be non-linear.

In another aspect, the present invention provides a method of using a fan-shaped stamp pad. A user applies a single diameter of a single stamp to a distal region of a first section of the stamp pad, thereby contacting the stamp with two or fewer, and preferably one, color of ink, then the user transfers the ink to an appropriate substrate, such as a piece of paper. The user then applies the single diameter of the stamp to a central region of the stamp pad, thereby contacting three or more, and preferably at least five or more, differently colored inks, followed by transferring such inks to such substrate (or another suitable substrate). Preferably, the surface of the stamp that contacts the stamp pad is cleaned between applications to the stamp pad. In an alternative embodiment, the order of the steps is reversed, such that the single diameter of the stamp is first applied to a large number of differently colored inks, followed by application to only one or two differently colored inks.

In yet another aspect, the present invention provides, in combination, a fan-shaped stamp pad and a stamp sized such that a single diameter of the stamp can contact three or more of the sections of the stamp pad near the central region, but contacts only one of the sections at the distal region.

From the foregoing, it will be appreciated that, although specific embodiments of the invention have been described herein for purposes of illustration, various modifications may be made without deviating from the spirit and scope of the invention. Accordingly, the invention is not limited except as by the appended claims.

I claim:

1. A stamp kit comprising:

a stamp pad, which comprises at least three sections containing differently colored inks, said at least three sections meeting at a series of junctures and radiating from a central region of said stamp pad, and each of said at least three sections having a proximal region located near said central region and a distal region located distant from said central region, said proximal region having a shorter width than said distal region, and a stamp, which is sized such that a single diameter of said stamp contacts said at least three sections of said stamp pad when applied to said central region of said stamp pad, but contacts only one of said at least three sections when said stamp is applied far from said central region.

2. The stamp kit of claim 1 wherein said stamp is sized such that said single diameter contacts all sections when applied at said central region.

3. A stamp pad comprising at least five sections containing differently colored inks, said at least five sections meeting at a series of junctures and radiating from a central region of the stamp pad, and each of said at least five sections having a substantially triangular shape with a point of said triangle located at said central region.

4. A stamp pad comprising at least three sections containing differently colored inks, said at least three sections meeting at a series of junctures and radiating from a central region of the stamp pad, and each of said at least three sections having a substantially triangular shape with a point of said triangle located at said central region.

* * * * *